United States Patent [19]

Ikegaya et al.

[11] 3,997,412

[45] Dec. 14, 1976

[54] METHOD OF FORMING OXIDE FILM ON ALUMINUM OR ALUMINUM ALLOY

[75] Inventors: Masashi Ikegaya; Fumio Shigeta, both of Shizuoka, Japan

[73] Assignee: Riken Light Metal Industry Co., Ltd., Tokyo, Japan

[22] Filed: Feb. 28, 1975

[21] Appl. No.: 554,017

[30] Foreign Application Priority Data

May 22, 1974 Japan ..... 49-57495

[52] U.S. Cl. ..... 204/58

[51] Int. Cl.[2] ..... C25D 11/08; C25D 11/10; C25D 11/14

[58] Field of Search ..... 204/58

[56] References Cited

UNITED STATES PATENTS 3,836,439 9/1974 Ikegaya et al. ..... 204/58

FOREIGN PATENTS OR APPLICATIONS 4,224,806 11/1967 Japan ..... 204/58

OTHER PUBLICATIONS

"The Surface Treatment & Finishing of Al" by Wernick et al., 1964, p. 272.

"Electroplating Engineering Handbook," 2nd Ed. by A. K. Graham, 1962, p. 438.

*Primary Examiner*—R. L. Andrews

*Attorney, Agent, or Firm*—McNenny, Pearne, Gordon, Gail, Dickinson & Schiller

[57] ABSTRACT

A method of forming an oxide film on the surface of an aluminum material by anodizing the aluminum material in an aqueous solution containing 0.5 to 10% by weight of oxalic acid and 0.05 to 1.0% by weight of sulfuric acid, in which either an electrolyzing voltage or the temperature of the aqueous solution is controlled in the range of 5 to 150V or 0° to 40° C, whereby the oxide film is colored in color tone from bronze to silver.

4 Claims, 3 Drawing Figures

METHOD OF FORMING OXIDE FILM ON ALUMINUM OR ALUMINUM ALLOY

BACKGROUND OF THE INVENTION

1. Field of the Invention

This invention relates to a method of forming a colored oxide film on the surface of an aluminum material or aluminum alloy (hereinafter referred to merely as the aluminum material), and more particularly to a method with which it is possible that an oxide film of such color tone in the range from a bronze color to a silver color is formed on the surface of the aluminum material by anodizing the aluminum material in an aqueous solution of oxalic acid containing sulfuric acid.

2. Description of the Prior Art

Generally speaking, since the aluminum material is light and small in deformation resistance as compared with other metal materials, it is fit for various uses and often used as a construction material or the like. The surface of such aluminum material now on the market is reinforced by anodic oxidation. Recently, the aluminum material which is subjected to the surface treatment by anodic oxidation is often colored during the anodic oxidation treatment and put on the market as a colored aluminum material.

However, the aluminum material thus put on the market as a colored aluminum material still encounters various problems in the coloring method and the range of colors obtainable with known methods is narrow.

The known methods of coloring the aluminum material is (a) a method employing an aqueous solution of oxalic acid and (b) a method employing an aqueous solution of aromatic sulfonic acid. The method (a) using the aqueous solution of oxalic acid is one that the aluminum material is anodized in the aqueous solution of oxalic acid to form a yellow-colored oxide film on the surface of the aluminum material. This method is very excellent because the oxalic acid which is the fundamental liquid is easily available and inexpensive and because the conditions for electrolysis are easy from the industrial point of view. On the other hand, this method has such a defect that the range of tone color obtainable with this method is limited to yellow, in particular, to pale yellow.

The method (b) is one that the aluminum material is anodized in the aqueous solution of aromatic sulfonic acid, as is the case with the method (a), thereby forming a bronze-colored oxide film on the surface of the aluminum material. Unlike the method (a), this method (b) is capable of coloring the oxide film in bronze and the range of color tone obtainable with this method is very wide. However, the method (b) is defective in that the aromatic sulfonic acid, i.e. the fundamental liquid of the aqueous solution used, is extremely expensive and that a relatively large amount of such an expensive fundamental liquid is required.

SUMMARY OF THE INVENTION

This invention is to provide a method of forming a colored oxide film on the surface of the aluminum material which is free from the aforementioned defect encountered in the prior art and in which the aluminum material is anodized in an aqueous solution of oxalic acid containing a small amount of sulfuric acid, thereby to form the colored oxide film. During the anodic oxidation treatment, the conditions for electrolysis, especially, a voltage, the amount of aluminum ions dissolved in the aqueous solution and the temperature of the solution, are controlled, by which the oxide film is colored in color tone in the range from a bronze to a silver color.

Other objects, features and advantages of this invention will become more apparent from the following description taken in conjunction with the accompanying drawings.

DESCRIPTION OF PREFERRED EMBODIMENTS

Figure 1:
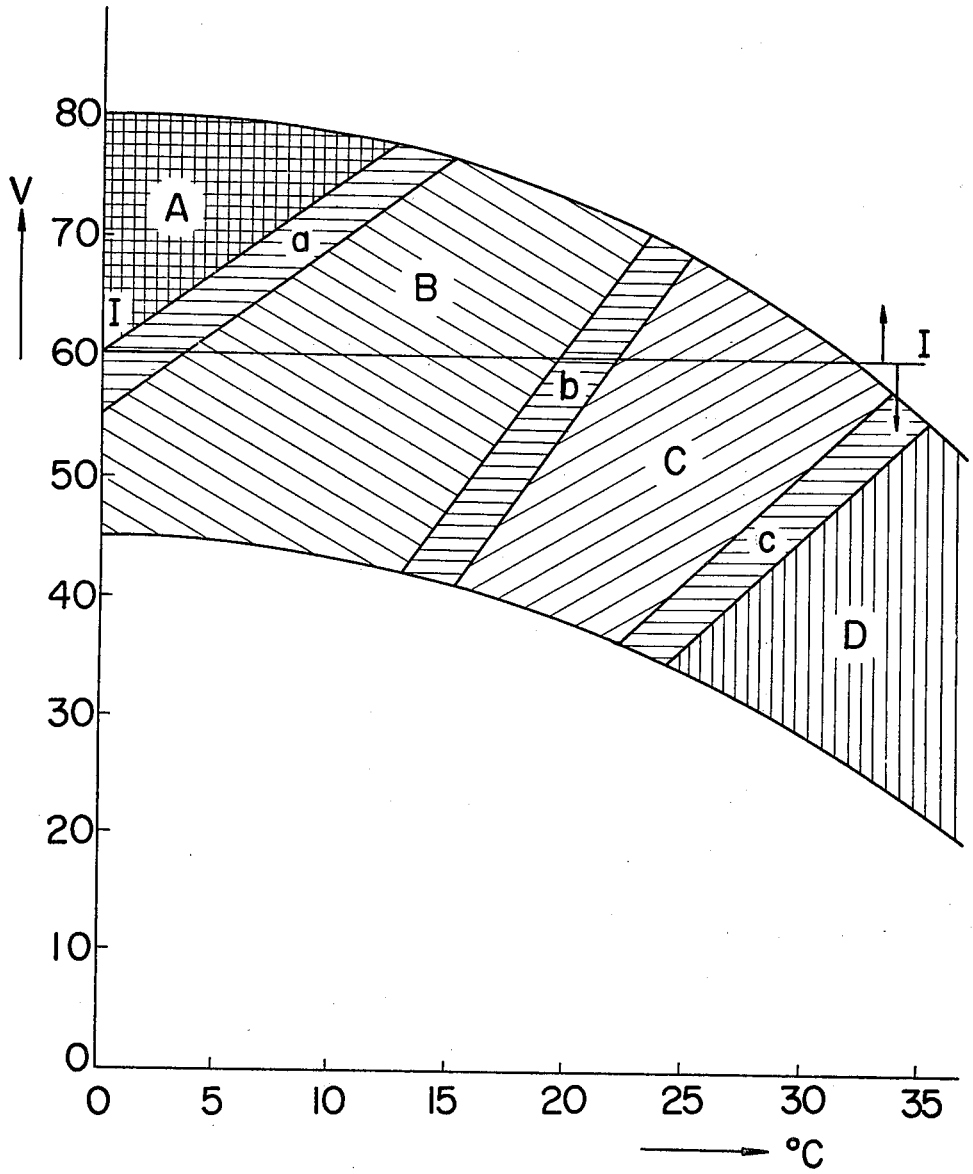
FIG. 1 is a graph showing the relationships among a voltage, the liquid temperature and color tone of a colored oxide film in the method of this invention.

Heretofore, methods of forming a bronze-colored oxide film on the surface of the aluminum material by anodizing the aluminum material in an aqueous solution containing oxalic acid and a small amount of sulfuric acid have been proposed in Japanese Pat. application Nos. 83336/1971, 83337/1971, 83338/1971, 52528/1972 and 66624/1972. Especially, the Japanese Pat. application No. 52528/1972 also proposes the anodic oxidation in an aqueous solution containing aluminum dissolved therein in addition to oxalic acid and a small amount of sulfuric acid. With these coloring methods, however, it is possible to obtain a bronze- or amber-colored oxide film but impossible to obtain a colorless or silver-colored oxide film. For obtaining the silver-colored oxide film, it is necessary to employ some other method.

On the other hand, although the method of this invention also employs the anodizing oxidation treatment in the aqueous solution containing oxalic acid and a small amount of sulfuric acid, it is possible to form an oxide film which is selectively colored over a wide range of color tone from a bronze to a silver color.

The method of this invention will hereinafter be described in detail, starting with the composition of aqueous solution.

1. Composition of aqueous solution a. 0.5 to 10 weight % (The weight % will hereinafter be referred to simply as %.)

As is well-known in the art, oxalic acid contributes to the formation of an oxide film on the surface of the aluminum material by anodizing oxidation. Also in this invention, oxalic acid is employed as the fundamental liquid of the aqueous solution for the above purpose. In this invention, however, oxalic acid is employed, noting that oxalic acid contributes as a coloring source to the formation of the oxide film due to its chemical constitution and that the mode of contribution as the coloring source varies in relation to an electrolyzing voltage used, in addition to the above purpose.

Namely, the oxide film formed by the anodic oxidation treatment is incomplete in its coupling and has a spinel structure of $AlO.Al_2O_3$. It appears that the coupling is unnatural. Therefore, it seems that the oxide film whose coupling is unnatural admits of invasion of other molecules and that if the molecules are capable of serving as coloring sources, the oxide film is colored.

In view of this, the present inventors have studied the molecules serving as coloring sources and, as a result of their study, it has been ascertained that oxalic acid may serve as a coloring source when it coexists with sulfuric acid described later on and that carboxyl groups in the oxalic acid are decomposed into high polymers, which serve as coloring sources.

The concentration of oxalic acid employed for the above purposes must be determined in relation to the conditions for electrolysis not only in view of the oxide film and its coloring but also in view of its color tone.

Namely, if at least 0.5% of oxalic acid is not contained in the aqueous solution, coloring of the oxide film is insufficient under the conditions for electrolysis later and, at the same time, it is impossible to change color tone of the oxide film only by changing the conditions for electrolysis and, further, the formation of the oxide film is insufficient and its conductivity is lowered, so that electric corrosion of the film is resulted. Further, where more than 10% of oxalic acid is contained, it presents a problem in its water solubility and the color of the oxide film does not come out well.

Thus, the amount of oxalic acid contained in the aqueous solution is determined but, preferably, in the range of 2.5 to 2.7%.

b. 0.05 to 1.0% of sulfuric acid

With the addition of sulfuric acid, it is possible to enhance the conductivity of the aqueous solution to some extent. In the present invention, the rate of sulfuric acid to oxalic acid, in other words, the rate of carboxyl groups and sulfonic group in sulfuric acid ($-SO_3H$), which are caused to invade in the oxide film, are properly altered, by which tone of the color of the oxide film is changed as required.

In this respect, the present inventors have concretely studied the relationship between aluminum ions dissolved in the aqueous solution and the coloring mechanism and, as a result of their study, have found the following facts.

With an increase in the amount of aluminum ions dissolved in the aqueous solution, the conductivity of the aqueous solution is lowered, which inevitably causes a decrease in the thickness of the oxide film obtained.

Accordingly, since the oxide film which is required to be of predetermined corrosion resistance and mechanical strength must be formed thick to some extent, it is possible to apply a high voltage with an increase in the amount of aluminum ions dissolved in the aqueous solution. Further, as will be described later on, as the voltage is altered, especially as the voltage is raised, the color tone of the oxide film changes from a silver to a bronze color. Consequently, required color tone can be obtained by controlling the relationship between the amount of aluminum ions dissolved in the aqueous solution and the voltage applied.

This fact becomes more remarkable when the amount of aluminum ions dissolved in the aqueous solution is small. For example, a predetermined current density is obtained even with a low voltage and an oxide film of a predetermined thickness can be readily formed but the oxide film is not ever colored, because neither decomposition nor formation of the above coloring factors takes place and because invasion of the coloring factors is not achieved. In this case, it is impossible to apply a high voltage and, even if it is applied, the oxide film is not colored but destroyed and the original object of the anodizing oxidation treatment of the aluminum material cannot be obtained.

Namely, the main factor for coloring the oxide film is the carboxyl group as described above and the oxide film is colored even with the invasion of the carboxyl groups only but when the sulfonic groups invade as auxiliary factors, color tone over a wide range from a bronze to a silver color can be obtained in accordance with the rate of the sulfonic group to the carboxyl group. Therefore, in the present invention, the upper and lower limits of the amount of sulfuric acid used are selected to be 1.0% and 0.05% respectively in view of the above fact. With the amount of sulfuric acid exceeding the upper limit value, burning is likely to occur and, with the amount of sulfuric acid being less than the lower limit value, color of the oxide film is deteriorated.

The amount of sulfuric acid may preferably be in the range of 0.14 to 0.17% in relation to the preferable range of the amount of oxalic acid contained in the aqueous solution.

2. Amount of aluminum ions: 0.05 to 6.0g/*l*

The aluminum ions dissolved in the aqueous solution serve as a factor for controlling the color tone of the oxide film together with the conditions for electrolysis. In this sense, the aluminum ions are used in this invention.

For example, as set forth in Japanese Pat. application No. 52528/1972, it is said that the aluminum ions dissolved in the aqueous solution prevent an overcurrent and also contribute to coloring of the oxide film to some extent. In the above Japanese patent application, however, there is neither teaching nor clarification of the mechanism that the aluminum ions dissolved in the aqueous solution contribute to coloring of the oxide film.

The relationship between the amount of the aluminum ions dissolved in the aqueous solution and the oxide film coloring mechanism is considered to be as follows but the present invention is greatly featured in that color tone of the oxide film is selected at will by changing the conditions for electrolysis, especially, a voltage. In this case, however, coloring of the oxide film requires a voltage which is high to some extent, so that current density is inevitably increased even at the price of destruction of the oxide film. This is not preferred from the viewpoint of economy of electrical energy. In the present invention, however, since the amount of aluminum ions dissolved in the aqueous solution is held in a proper range, electrolysis is achieved at high voltage but with a small current. This is one of the features of the present invention.

The amount of dissolved aluminum ions which is selected to be in the aforementioned range has the above effects. In order to exhibit such effects, the amount of dissolved aluminum ions per liter of aqueous solution is preferred to be in the range of 0.05 to 6.0g/*l* in view of the relationships with the composition of the aqueous solution, particularly with its conductivity, and the conditions for electrolysis, particularly with the voltage therefor. When the amount of dissolved aluminum ions is less than 0.05g/*l*, the above effect, especially coloring, cannot be obtained. When the amount of dissolved aluminum ions is in excess of 6.0g/*l*, the conductivity of the aqueous solution is lost to interfere with electrolysis.

3. Conditions for electrolysis

Voltage in the range of 5 to 150V

The voltage is one of the most significant control factors in this invention. In this sense, selection of the range of voltage used is indispensable to this invention.

As described above, the coloring mechanism of this invention is such that oxalic acid and sulfuric acid contained in the aqueous solution are decomposed to form coloring factors and behavior of the coloring factors such as invasion into the oxide film, coupling therewith, etc. is controlled, thereby to color the oxide film in desired color tone. In this case, the voltage during electrolysis achieves predetermined electrolysis and also contributes to the formation of the coloring factors and to invasion of the coloring factors into the oxide film and coupling of them with the film.

Although the voltage contributes to such operations, the voltage and the degree of its contributions are not always related to each other linearly. It might be said that the degree of contributions of the voltage to the operations is determined depending upon the liquid temperature, the amount of dissolved aluminum ions, the amount and composition of the liquid and the distance between anode and cathode electrodes rather than the magnitude of the voltage used. From this point of view, in the present invention, color tone of the oxide film is changed by altering the voltage in relation to the above control factors. Only where the factors except the voltage and the amount of dissolved aluminum ions are in such ranges as will be described later on, the voltage is changed in relation to the liquid temperature and the amount of dissolved aluminum ions, by which oxide films in different colors can be formed. This is one of the features of the present invention.

Namely, the coloring factors are the carboxyl and the sulfonic groups and these factors are formed by decomposition of oxalic acid and sulfuric acid, as described above. In order that the decomposition may proceed and that coloring due to invasion of the coloring factors in the oxide film and their coupling therewith may proceed, a certain amount of energy is required, which is a reference voltage. Accordingly, if energy exceeding the reference voltage is not directly applied during electrolysis, coloring of the oxide film is not effective and, further, in a range above the reference voltage, a change in color tone due to a voltage change becomes remarked. However, only one part of the voltage being applied has the function of the reference voltage and the other part is consumed by the above factors. The present inventors' studies indicate that in the case where the composition of the aqueous solution and the amount of aluminum ions dissolved therein are in the aforesaid ranges, when a voltage higher than 60V is applied, a change in color tone of the oxide film, is remarked.

For example, FIG. 1 shows the relationship between the voltage and the temperature of the aqueous solution in the case where an aluminum alloy A.A6063 was treated for coloring according to this invention. As is apparent from FIG. 1, regions A, B and C corresponding to bronze, amber and light amber colors, respectively, all lie above the line I—I and, in this region, oxide films of various colors can be obtained only by changing the liquid temperature. Further, in the region below the line I—I, the influence of the voltage on coloring is lessened and, especially in this region, by raising the liquid temperature while maintaining the voltage low, even a silver color inclining toward colorlessness can be obtained.

The value of the line I—I in FIG. 1 varies with the composition of the electrolytic bath, conductivity of the aluminum material, etc. but, in any case, a constant voltage corresponding to the line I—I exists at all times.

In practice, an appropriate value of the voltage thus applied is also dependent upon the distance between the both electrodes in the electrolytic bath and the amount of the aqueous solution. Appropriate values of the voltage in the case where the liquid temperature is 10° C and a mean current density is 15A/dm$^2$ are such as given the Table 1.

Table 1

| Amount of liquid | Distance between electrodes | Voltage |
|---|---|---|
| 3l | 8 cm | 50V |
| 50×10$^3$l | 45 cm | 70V |
| 15×10$^3$l | 40 cm | 65V |

Generally speaking, an increase in the distance between the electrodes causes an increase in the resistance of the aqueous solution, which raises the voltage. With an increase in the amount of the aqueous solution, the resistance of the aqueous solution also increases to raise the voltage. Therefore, as indicated in the Table 1, when the voltage is raised, for example, by properly controlling the distance between the electrodes, color tone of the oxide film can easily be controlled.

The voltage range in which the above effect can be retained is 5 to 150V. With a voltage lower than 5V, even if the conductivity of the aqueous solution is enhanced by the liquid temperature and other factors, the above effect cannot be obtained. With a voltage higher than 150V, even if the other conditions are controlled, destruction of the oxide film is resulted.

b. Temperature of aqueous solution

When the aqueous solution is regarded as an electrolytic bath, the liquid temperature is closely connected with its conductivity. With a rise of the liquid temperature, the conductivity is enhanced. In this sense, the rate of the voltage contributing as the reference voltage increases with the rise of the liquid temperature, as shown in FIG. 1. However, even if the conductivity is enhanced by raising the liquid temperature, blushing of the oxide film occurs and its quality is deteriorated thereby. In view of this, the upper limit of the liquid temperature is selected to be 40° C. Further, the liquid temperature can be appreciably lowered as a control factor but too low a liquid temperature requires an expensive cooling equipment, so that the lower limit of the liquid temperature is selected to be 0° C.

Figure 2:
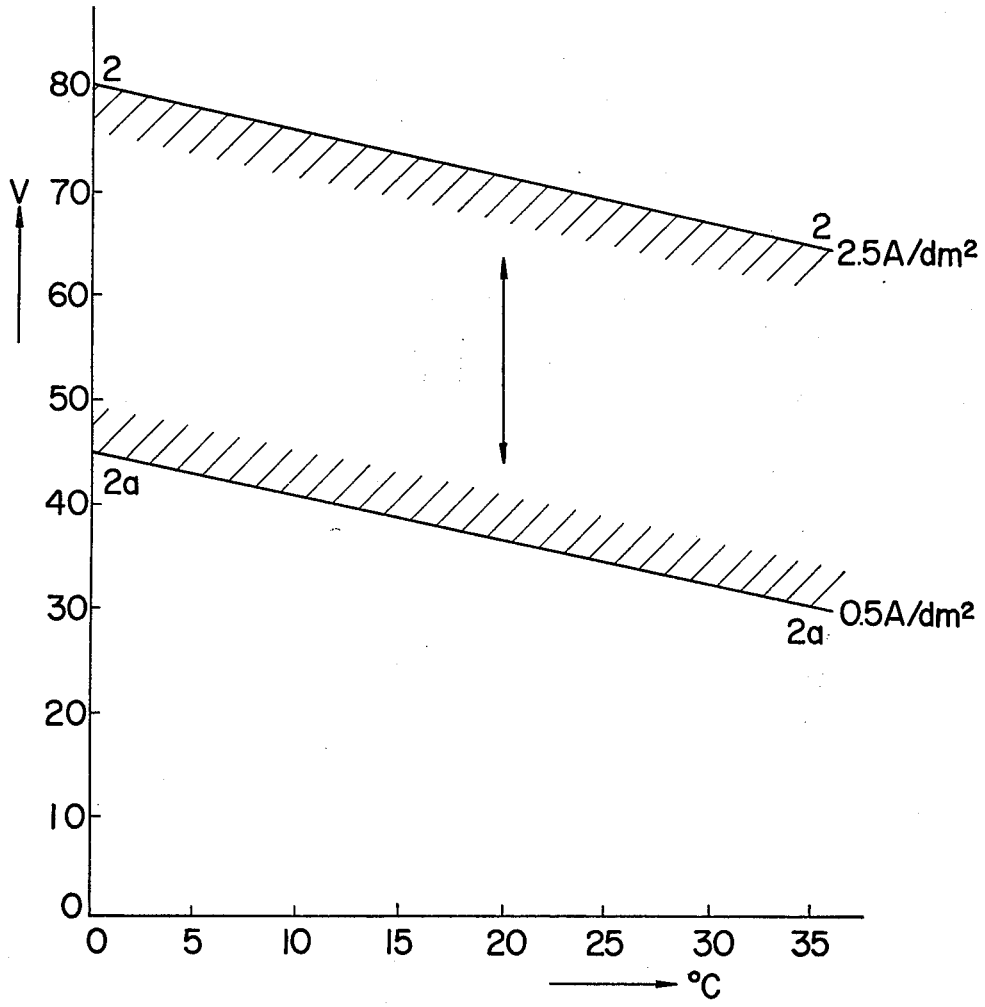
FIG. 2 is a graph showing the relationships among the voltage, the liquid temperature and the current density used in the method of this invention.

As described above, the voltage and the liquid temperature bear a close relationship with each other. This relationship is such as shown in FIG. 2. In FIG. 2, the line 2—2 indicates a curve of an equal current density of 2.5A/dm$^2$ and the line 2*a*–2*a* indicates that of 0.5A/dm$^2$. By respective parallel lines between these curves, curves of equal current densities in the range of 2.5A/dm$^2$±0.5A/dm$^2$ can be obtained.

Accordingly, when the mean current density on the aluminum material is in the range of 0.5 to 2.5A/dm$^2$, the electrolyzing voltage is raised and the liquid temperature is lowered or vice versa, by which the current density is maintained constant, particularly low, and oxide films of various colors can be obtained. This leads to remarked reduction of electric power energy.

c. Current density

The current density has no direct relation to coloring but contributes to the formation of the oxide film. From this point of view, it is preferred that the current density is in the range of 0.5 to 5A/dm² but the method of this invention is featured in that coloring of the oxide film is possible in a small current range.

d. Other conditions

Figure 3:
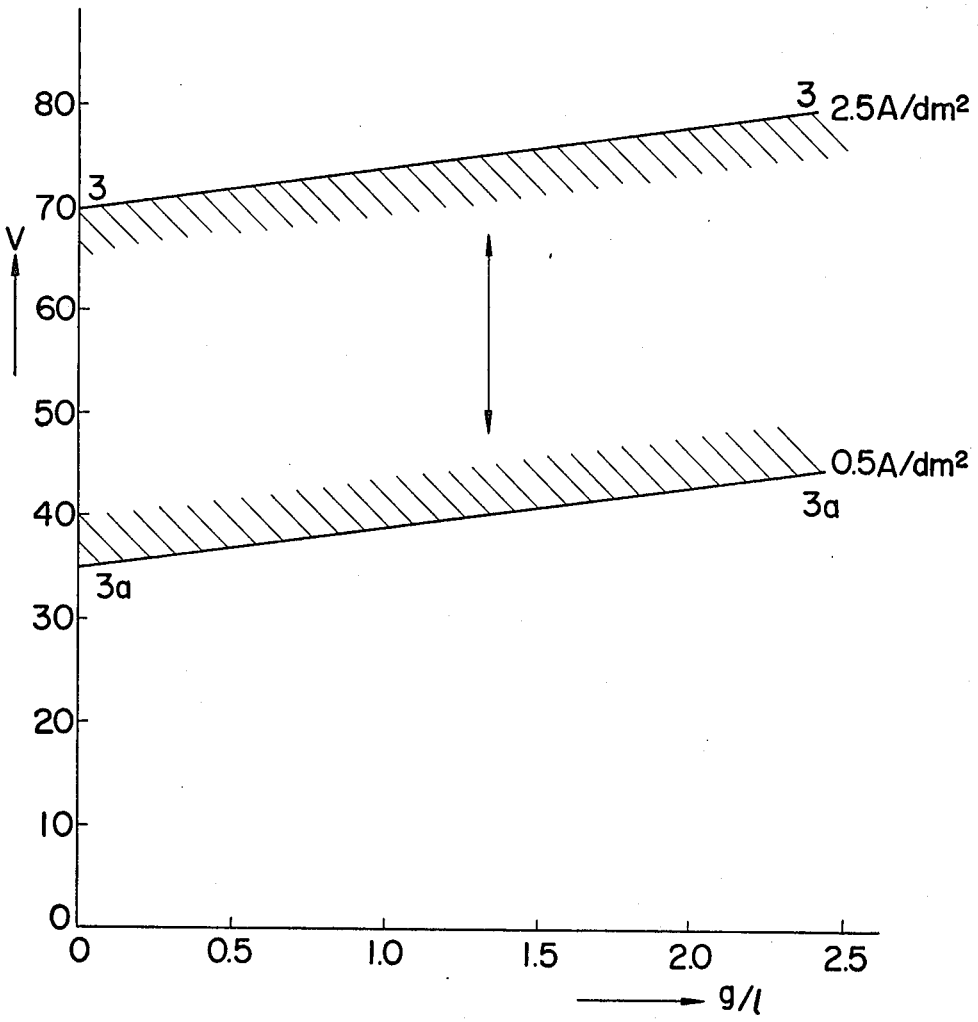
FIG. 3 is a graph showing the relationships among the voltage, the amount of aluminum ions dissolved in an electrolyte and the current density in the method of this invention.

There are various factors other than the above ones as the conditions for electrolysis. Of these factors, the aforementioned amount of aluminum ions dissolved in the aqueous solution is the most important. The relationship between the amount of dissolved aluminum ions is shown in FIG. 3. This relationship is the same as that in FIG. 2. The line 3—3 indicates a curve of an equal current density of 2.5A/dm² and the line 3*a*–3*a* indicates that of 0.5A/dm².

Accordingly, when the mean current density on the aluminum material, the electrolyzing voltage and the amount of aluminum ions dissolved in the aqueous soluble are increased, by which the mean current density is maintained at a low but constant value and oxide films of various colors can be obtained. This accomplishes remarked reduction of electric power energy.

Further, the time for electrolysis presents a problem as one of the conditions for electrolysis. Namely, where the conditions for electrolysis other than the time for electrolysis, for example, the composition of the aqueous solution serving as an electrolytic bath, the electrolyzing voltage, the mean current density, the temperature of the aqueous solution, etc. are held unchanged, if the time for electrolysis is selected longer, the thickness of the oxide film is increased and, also, its color tone is deepened. Especially, when the time for electrolysis is selected extremely long, an oxide film of a black color or a color inclined toward it can be obtained.

Moreover, a current which is applied during electrolysis also poses a problem. This current is usually a DC but may be a AC-DC superimposed current, a combination of AC and DC an incompletely rectified wave or a pulse wave, in which case, it is sufficient only to lower its voltage as compared with that in the case of DC.

4. Quality of aluminum material

With the method of this invention, even if the quality of the aluminum material is changed, a colored oxide film can be formed but its color tone varies to some extent. The reason for this appears such that the amounts of alloys contained in the aluminum and the alloys themselves change with the variation of the quality of the aluminum material to cause a change in the conductivity of the aluminum material.

The present inventors treated aluminum materials of such compositions as shown in Table 2 with the method of this invention and the results given in Table 3 were obtained.

Table 2

| Alloy (A.A.) | Aluminum | Copper | Iron | Silicon | Manganese | Magnesium | Zinc | Chromium | Titanium | Other elements Single amount | Other elements Total amount |
|---|---|---|---|---|---|---|---|---|---|---|---|
| 1099 | 99.99 min. | — | — | — | — | — | — | — | — | — | — |
| 1100 | " | — | — | — | — | — | — | — | — | — | — |
| 2011 | residue | 5.0~6.0 | 0.7 | 0.40 | — | — | 0.30 | — | — | 0.05 | 0.15 |
| 2014 T3 | " | 3.9~5.0 | 1.0 | 0.50~1.2 | 0.40~1.2 | 0.20~0.8 | 0.25 | 0.10 | 0.15 | 0.05 | 0.15 |
| 2024 T3 | " | 3.8~4.9 | 0.50 | 0.50 | 0.3~0.9 | 1.2~1.8 | 0.25 | 0.10 | — | 0.05 | 0.15 |
| 3003 | " | 0.20 | 0.70 | 0.60 | 1.0~1.5 | — | 0.10 | — | — | 0.05 | 0.15 |
| 4043 | " | 0.30 | 0.80 | 4.5~6.0 | 0.05 | 0.05 | 0.10 | — | 0.20 | 0.05 | 0.15 |
| 5005 | " | 0.20 | 0.7 | 0.40 | 0.20 | 0.50~1.1 | 0.25 | 0.10 | — | 0.05 | 0.15 |
| 5052 | " | 0.10 | & maximum | 0.45 | 0.10 | 2.2~2.8 | 0.10 | 0.15~0.35 | — | 0.05 | 0.15 |
| 5086 | " | 0.10 | & 0.50 | 0.40 | 0.20~0.7 | 3.5~4.5 | 0.25 | 0.05~0.25 | 0.15 | 0.05 | 0.15 |
| 5357 | " | 0.07 | 0.17 | 0.12 | 0.15~0.45 | 0.8~1.2 | — | — | — | 0.05 | 0.15 |
| 6061 T6 | " | 0.15~0.40 | 0.70 | 0.4~0.8 | 0.15 | 0.8~1.2 | 0.25 | 0.15~0.35 | 0.15 | 0.05 | 0.15 |
| 6663 T6 | " | 0.10 | 0.35 | 0.20~0.6 | 0.10 | 0.15~0.9 | 0.10 | 0.10 | 0.10 | 0.05 | 0.15 |
| 7075 T6 | " | 1.2~2.0 | 0.5 | 0.50 | 0.30 | 2.1~2.9 | 5.1~6.1 | 0.18~0.40 | 0.20 | 0.05 | 0.15 |

Table 3

| Names of Alloys | Color |
|---|---|
| 1099 | Lustrous yellowish brown |
| 1100 | Yellowish brown |
| 2011 | Reddish brown |
| 2014 | Reddish brown |
| 2024 | Reddish brown |
| 3003 | Deeply bluish gray |
| 4043 | Blackish gray |
| 5005 | Yellowish brown |
| 5052 | Greenish brown |
| 5086 | Blackish brown |
| 5357 | Pale brown |
| 6061 | Bronze |
| 6063 | Brown |
| 7075 | Blackish brown |

As is evident from the results given in Table 3, when the method of this invention was employed, even if the quality of the aluminum materials changed, oxide films were all colored in bronze or in amber.

This invention will be further described by the following examples.

EXAMPLE 1

In an aqueous solution of the composition shown in Table 4, aluminum materials A.A1100 were each electrolyzed under the conditions for electrolysis shown in Table 4. Oxide films of such colors as given in Table 4 could be formed.

Namely, as shown in Table 4, by selectively changing the conditions for electrolysis while using the same aqueous solution, oxide films of such color tone as a bronze to a silver color could be obtained.

Table 4

| Composition of aqueous solution | | | Conditions for electrolysis | | | | Film formed | |
|---|---|---|---|---|---|---|---|---|
| Oxalic acid | Sulfuric acid | Dissolved aluminum | Voltage | Mean current density | Bath temperature | Time for treatment | Thickness of film | Color |
| | | | 80V | 2.5A/dm² | 5° C | 15 min. | 10μ | bronze |
| | | | 75 | 2.0 | 5 | 22 | & 11 | bronze |
| | | | " | 2.0 | 5 | 8 | 4 | amber~bronze |
| | | | 70 | 1.2 | 10 | 30 | 10 | bronze |
| | | | " | 1.2 | 10 | 20 | 7 | amber~bronze |
| | | | " | 1.2 | 10 | 10 | 3.5 | amber |
| | | | 65 | 1.2 | 15 | 60 | 20 | bronze |
| 2.5~2.7% | 0.15~0.17% | 1.8~2.0g/l | " | 1.2 | 15 | 40 | 13 | amber~bronze |
| | | | " | 1.2 | 15 | 25 | 8 | amber |
| | | | 60 | 1.2 | 20 | 35 | 12 | amber |
| | | | " | 1.2 | 20 | 20 | 7 | light amber~amber |
| | | | 55 | 1.2 | 25 | 40 | 13 | light amber~amber |
| | | | " | 1.2 | 25 | 20 | 7 | light amber |
| | | | 50 | 1.0 | 25 | 15 | 4 | light amber |
| | | | " | 1.0 | 25 | 10 | 3 | silver~light amber |
| | | | 45 | 0.8 | 27 | 30 | 7 | light amber |
| | | | " | 0.8 | 27 | 15 | 3.5 | silver~light amber |
| | | | 40 | 0.8 | 30 | 20 | 5 | silver |
| | | | 35 | 1.0 | 35 | 30 | 8 | silver |

EXAMPLE 2

An aqueous solution containing 2.66% of oxalic acid, 0.152% of sulfuric acid and 1.836g/*l* of aluminum dissolved therein was used as an electrolytic bath, in which aluminum materials A.A1099, 1100, 5052, 6063 and 7074 were anodized by a three-phase full-wave rectified direct current at 50V for 30 minutes. Such colored oxide films as shown in Table 5 were formed.

Table 5

| Names of alloys | Color | Thicknesses of films |
|---|---|---|
| 1099 | Light (lustrous) yellowish brown | 14μ |
| 1100 | Yellowish brown | 12μ |
| 5052 | Yellowish brown | 13μ |
| 6063 | Brown | 13.5μ |
| 7074 | Blackish brown | 15μ |

As has been described in detail in the foregoing, in the present invention, noting the compositional feature of the aqueous solution containing oxalic acid and sulfuric acid, the voltage is properly controlled and, at the same time, the amount of aluminum ions dissolved in the aqueous solution and the temperature of the aqueous solution are also controlled and, by changing these conditions to be controlled, an oxide film of color tone from a bronze to a silver color is obtained as required. Accordingly, with the method of this invention, only by changing the conditions for electrolysis without changing the composition of the aqueous solution, a colored oxide film of desired color tone can be formed. Further, also in the case of obtaining a bronze-colored oxide film by increasing the value of the voltage included in the conditions for electrolysis, by properly controlling the other conditions for electrolysis, electrolysis of low current density can also be achieved, and consequently electrolyzing energy can be greatly saved.

It will be apparent that many modifications and variations may be effected without deparing from the scope of the novel concepts of this invention.

We claim as our invention:

1. A method of forming a silver tone color oxide film on the surface of an aluminum material by anodizing said aluminum material in an aqueous solution consisting essentially of 2.5 to 2.7% by weight of an oxalic acid, 0.15 to 0.17% by weight of sulfuric acid and 1.8 to 2.0 g/*l* of aluminum ions, applying an electrolyzing voltage in the range of from about 20 volts to about 55 volts and maintaining the temperature of said aqueous solution in the range of from about 25° C. to about 40° C. for a time period in the range of from about 10 minutes to about 30 minutes, whereby said oxide film is provided with a color tone of silver.

2. A method according to claim 1, wherein said electrolyzing voltage and the temperature of said aqueous solution are controlled to maintain the mean current density on said aluminum material at a constant value in the range of 0.5 to 2.5A/dm², whereby the color tone of said oxide film is controlled.

3. A method according to claim 1, wherein said electrolyzing voltage and the amount of aluminum ions in said aqueous solution are controlled to maintain the mean current density on said aluminum material at a constant value in the range of 0.5 to 2.5A/dm², whereby the color tone of said oxide film is controlled.

4. A method according to claim 1, wherein said oxide film is provided with the color tone relationships shown in FIG. 1 as a function of the selected electrolyzing voltage and aqueous solution temperature.

* * * * *